United States Patent [19]

Morrison et al.

[11] Patent Number: 4,635,435

[45] Date of Patent: Jan. 13, 1987

[54] VACUUM SPINNING FROM SLIVER

[75] Inventors: Elbert F. Morrison, Clarksville, Va.; Danny R. Bradley, Bullock; D. C. Reece, Oxford, both of N.C.

[73] Assignee: Burlington Industries, Inc., Greensboro, N.C.

[21] Appl. No.: 732,256

[22] Filed: May 9, 1985

Related U.S. Application Data

[63] Continuation-in-part of Ser. No. 677,487, Dec. 3, 1984.

[51] Int. Cl.[4] ..... D01H 5/28; D01H 1/12; D01H 1/13; D02G 1/04

[52] U.S. Cl. ..... 57/328; 57/5; 57/204; 57/224; 57/334; 57/341; 57/401; 57/403

[58] Field of Search ..... 57/5, 6, 12, 204, 210, 57/224, 328, 334, 409, 400–403, 341–344

[56] References Cited

U.S. PATENT DOCUMENTS

| | | | |
|---|---|---|---|
| 3,079,746 | 3/1963 | Field, Jr. | 57/328 |
| 3,757,507 | 9/1973 | Maxham | 57/409 X |
| 3,802,174 | 4/1974 | Landwehrkamp et al. | 57/5 |
| 3,978,648 | 9/1976 | Yamagata et al. | 57/5 X |
| 4,183,202 | 1/1980 | Morihashi | 57/328 |
| 4,265,082 | 5/1981 | Sasaki et al. | 57/328 X |
| 4,322,944 | 4/1982 | Sraitr et al. | 57/328 |
| 4,507,913 | 4/1985 | Morrison | 57/328 |

FOREIGN PATENT DOCUMENTS

| | | |
|---|---|---|
| 143050 | 10/1971 | Czechoslovakia . |
| 880239 | 10/1961 | United Kingdom . |

*Primary Examiner*—John Petrakes

*Attorney, Agent, or Firm*—Nixon & Vanderhye

[57] ABSTRACT

Yarn having properties approaching that of ring spun yarn is produced by vacuum spinning, including directly from sliver. The elongated hollow shaft of the vacuum spinning apparatus has a vacuum reservoir, or interior chamber, that is generally in the shape of a right circular cone, and the interior passageway of the shaft from the first end thereof to the interior chamber can have the form of a right circular cone frustum. The perforations operatively connected to the interior chamber have a generally wedge-shape. The perforations and the passageway sections between the first end of the shaft and the perforations are dimensioned so that they allow sufficient air flow to achieve optimum fiber wrapping action.

20 Claims, 7 Drawing Figures

VACUUM SPINNING FROM SLIVER

CROSS-REFERENCE TO RELATED APPLICATIONS

This application is a continuation-in-part of application Ser. No. 677,487 filed Dec. 3, 1984, the disclosure of which is hereby incorporated by reference herein.

BACKGROUND AND SUMMARY OF THE INVENTION

In U.S. Pat. No. 4,507,913 (which is incorporated by reference herein) and in parent application Ser. No. 677,487 filed Dec. 3, 1984, methods and apparatus are provided for efficiently and effectively producing yarn having properties approaching those of ring spun yarn, but at much greater speeds. The basic technique disclosed in said patent and parent application is known as "vacuum spinning", and has a number of advantages compared to conventional techniques.

Until relatively recently, ring spinning equipment has made up approximately 90 percent of all spinning equipment. However several new high speed procedures have recently been utilized including open end spinning, friction spinning, hollow core spinning, and air jet spinning. None of these new commercial systems has been successful in the production of long staple yarn, however, especially for apparel fabrics. However vacuum spinning is capable of producing long stable yarn suitable for use in apparel fabrics, the yarn approaching the properties of ring spun yarn.

Vacuum spinning has a number of advantages compared to conventional ring spinning. These include the following: Productivity can be expected to be at least 6–8 times that of commercial ring spinning. Despite this increased productivity, the properties of the yarn are more like ring spun yarn than open end or air jet type yarns. The horsepower per pound of yarn produced is considerably less than that for air jet spinning using compressed air. Vacuum spinning lends itself to automatic end piece-up, automatic slubbing, automatic adaptation, the production of large delivery packages, and the utilization of large supply packages (e.g. 25 lb. cans of sliver). A wide count range can be provided on long staple yarns, at least ⅛'s to 1/60's on 55 percent polyester/45 percent wool, and at least ⅛'s to 1/40's on 100 percent wool. There are lower labor costs per pound of yarn produced compared to ring spun yarn.

Further advantages of the invention are as follows: The process lends itself to high draft ratios (e.g. 10–80), can be modified to run both long and short staple yarns, and can make yarn having either "S" or "Z" twist. A number of unique novelty yarns can be produced, such as described in co-pending application Ser. No. 680,510 filed Dec. 11, 1984. The apparatus is simple and easy to maintain, and the noise level can be controlled by locating the vacuum pump in a separate location, to thereby ensure compliance with OSHA regulations. The apparatus runs cleanly since the vacuum automatically removes lint fly, and like contaminants, and oily waste is not introduced. Waste is reduced due to draft zone stoppage on end breaks, with a reduction in end breakage of about 400 percent compared to ring spinning since there is no tension in the yarn. Also thread-up of the broken ends can be accomplished with minimum operator intervention. The system can be run using higher weight sliver (e.g. 55 grains per yarn compared to 35–40 grains per yarn which is conventional), and carpet yarn can be produced too by lengthening the draft zone and providing a larger nozzle. Yarn steaming may not be required for most counts-blends for handling, although it may be required for uniform dyeability, and steaming is easy to effect.

The apparatus and method according to the present application have basically all the same advantages described above with respect to vacuum spinning in general. Additionally, according to the present invention in the production of yarn from roving it is possible to construct the "nozzle" of the vacuum spinning apparatus in a simpler and more advantageous manner. By providing an interior generally conically shaped vacuum reservoir, instead of a spherical vacuum reservoir, ease of production is facilitated and a yarn having a slightly better break strength can be produced.

Also according to the present invention the production of yarn directly from sliver is faciliated. According to the present invention a method of spinning yarn is provided which includes the steps of: drafting a sliver of fibers so as to produce a drafted sliver; feeding the drafted sliver in a linear direction in a fiber mass; passing the fiber mass into the interior of a hollow shaft ("nozzle") rotatable about an axis coincident with the direction of movement of the fibers; applying a vacuum to the circumferential exterior of a perforated portion of the shaft so that some of the fiber mass inside the shaft is attracted toward the shaft interior surface; and rotating the shaft at high speed (e.g. 3550 rpm) so that the ends of certain of the fibers interior of the shaft rotate with the shaft as they move linearly, and so that those ends extend into an interior chamber of the hollow shaft so as to ultimately wrap around other portions of the fiber mass, to produce a final yarn. Utilizing the method of the invention it is possible to produce a final yarn having a break strength comparable to a break strength of at least 500 grams per denier for a yarn produced from 1/19's count fibers of 55 percent polyester and 45 percent wool.

The particular "nozzle" for producing yarn having good strength properties directly from sliver, according to the present invention, preferably includes a generally conically shaped interior chamber. The perforations in communication with the interior chamber are generally wedge-shaped, and the size of the interior passageway in the shaft adjacent the first end thereof is very large compared to the diameter of the shaft passageway between the interior chamber and the second end of the shaft, and may have the shape of a right circular cone frustum. The interior chamber is dimensioned so that it is large enough to allow free fiber movement so that the fibers will be lifted up and wrap around a core of the fiber mass more securely, however the interior chamber should not be so big that the fibers will be pulled through the perforations by the vacuum source. The perforations and the passageway between the first end of the shaft and the perforations, are dimensioned so that optimal wrapping action can be achieved. That is, the dimensions are large enough so that they allow sufficient air flow that they do not prevent the attainment of optimal fiber wrapping action. In this way optimal wrap for any given application may be achieved.

It is the primary object of the present invention to provide effective refinements and modifications of methods and apparatus for vacuum spinning of yarn. This and other objects of the invention will become clear from an inspection of the detailed description, and from the appended claims.

DETAILED DESCRIPTION

Basic apparatus for vacuum spinning is shown in commonly assigned U.S. Pat. No. 4,507,913, and in parent application Ser. No. 677,487 filed Dec. 3, 1984. The particular apparatus, and procedures, according to the present invention provide further refinements and modifications of the prior vacuum spinning apparatus, particularly in the forming of yarn from sliver.

Figure 1:
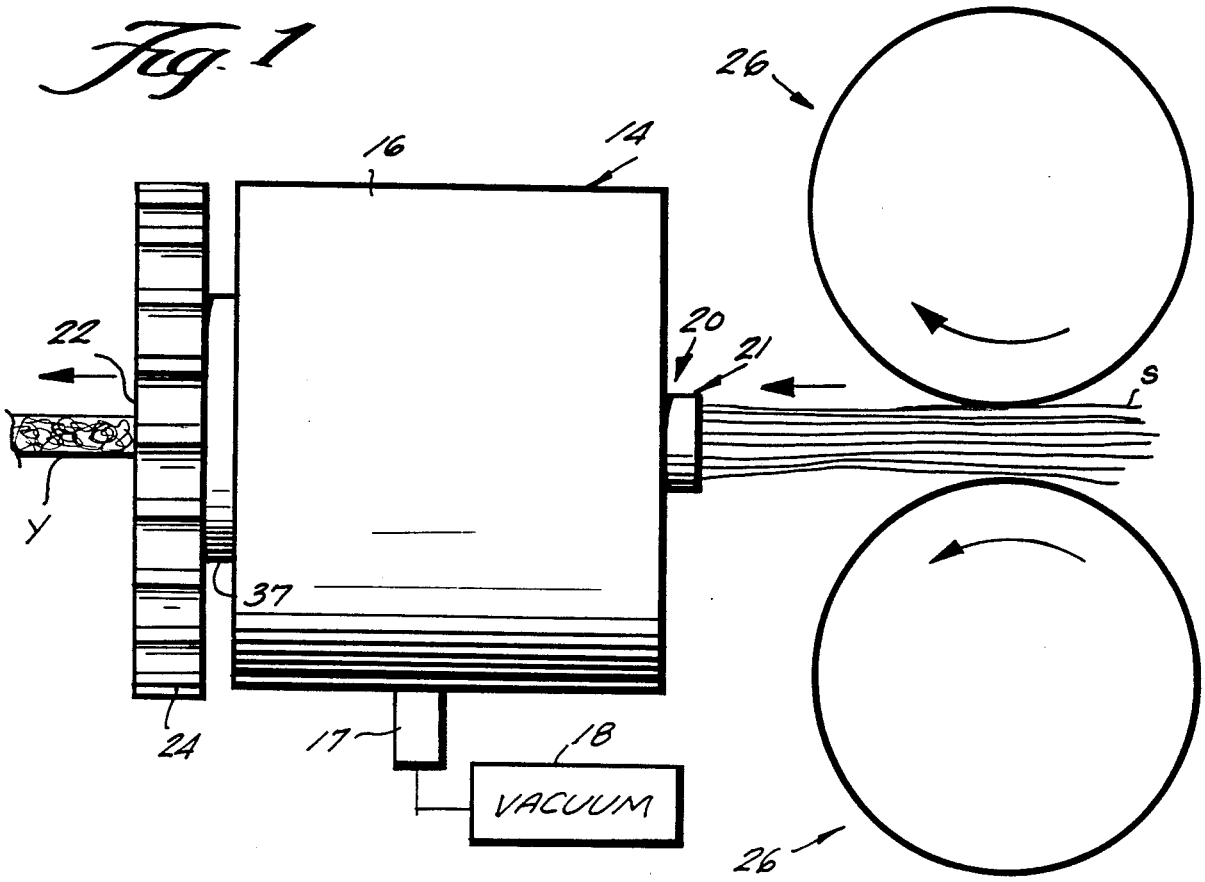
FIG. 1 is a side view of exemplary apparatus according to the present invention, shown in schematic cooperation with a vacuum source and feed rollers.

The basic vacuum spinning apparatus 14 illustrated in FIG. 1 is similar to that shown in the co-pending application Ser. No. 677,487 except for details of the drive mechanism and the interior "nozzle". The apparatus 14 comprises an outer housing 16, of metal, ceramic, or the like, which is operatively connected up through integral nipple 17 to a vacuum source 18, such as a vacuum pump which provides 20 inches of mercury at 19 cfm (or more). The interior of the housing 16 is hollow. The interior "nozzle" of the apparatus 14 is indicated generally by reference numeral 20, and includes a first end 21 thereof and a second end 22. At the second end 22 a gear 24 is mounted, which is connected to appropriate other gears and drives (not shown) for effecting rotation of the "nozzle" 20. The drives can rotate the "nozzle" 20 either clockwise or counterclockwise to provide either a Z or S twist, as desired.

From a draft system (not shown in the drawings, but described in the parent application) a sliver S passes through the nip of the front feed rolls 26, and the produced yarn Y exits from the second end 22 of the apparatus 14.

Figure 2:
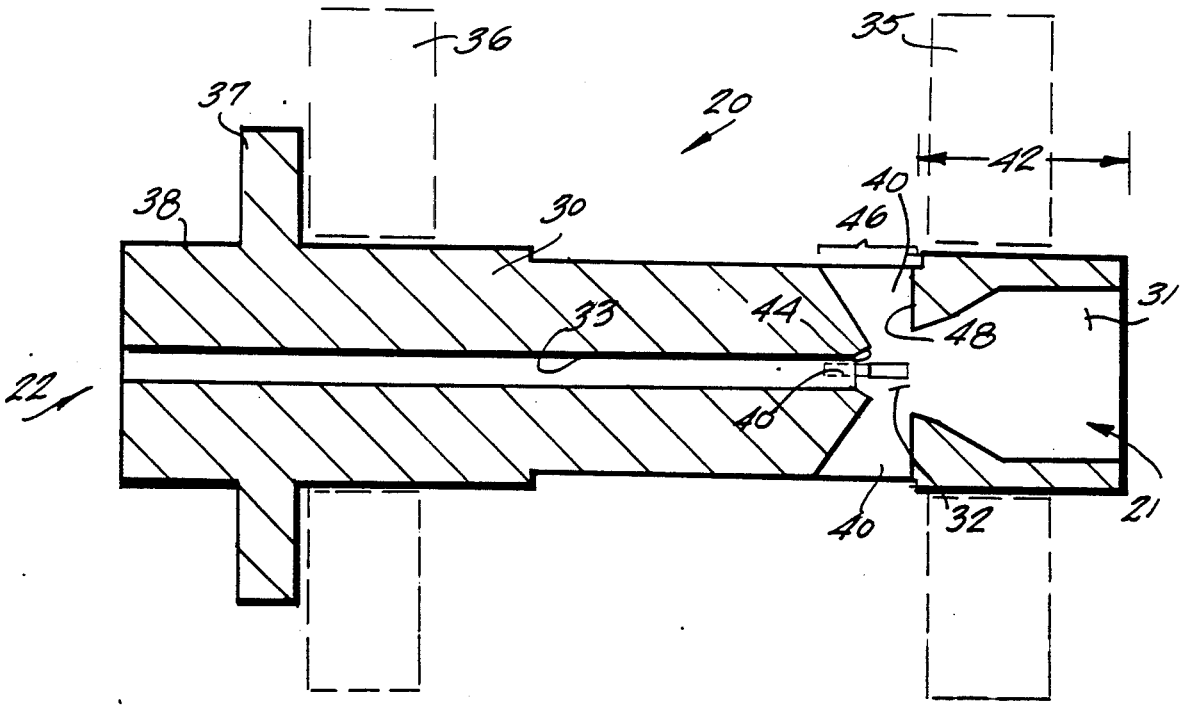
FIG. 2 is side cross-sectional view of an exemplary "nozzle" for use with the vacuum spinning apparatus of FIG. 1.

A preferred "nozzle" 20 according to the present invention for the production of yarn from sliver is shown in detail in FIG. 2. The "nozzle" 20 comprises an elongated hollow shaft 30 having a first end 21 and a second end 22. A through-extending passageway goes from the end 21 to the end 22. The passageway includes a first portion 31 adjacent the first end 21, an interior chamber portion 32 close to, but spaced from, the first end 21, and a third portion 33 that extends from the portion 32 all the way to the second end 22. In the specific embodiment illustrated in FIG. 2, the diameter of the portion 33 is 1/16th of an inch, and is substantially constant.

Mounting the shaft within the casing 16 for rotation preferably bearings 35, 36 are provided, comparable to the bearings 80, 83 in the parent application. An annular shaped flange 37 extends outwardly from, and is integral with, the shaft 30 adjacent the end 22, and the bearing 36 abuts the flange 37. To the exterior cylindrical surface 38 of the shaft 30 the gear 24 is press-fit so that rotation of the gear 24 effects rotation of the shaft 30.

The shaft 30 illustrated in FIG. 2 is one that is particularly adapted for forming yarn Y from a sliver, rather than from a roving. The production of yarn directly from sliver, instead of from roving, of course has a number of advantages since it essentially eliminates a step (and the associated equipment for performing the step) in the yarn formation process. It has been found, according to the invention, that in the production of yarn from sliver, instead of from a roving, it is necessary to maximize the air flow from the first end 21 to the vacuum source 18, while still providing a restricted enough path for the movement of the fibers so that they are not pulled out of the shaft 30 by the vacuum. In the specific embodiment illustrated in FIG. 2, this maximized air flow is provided by making the dimensions of the first passageway section 31 very large compared to the section 33, and providing perforations 40 that have a total effective area generally comparable to the effective operative area of flow in the passageway section 31, so that optimum wrap of fibers is achieved.

The passageway section 31 is substantially circular in cross-section, and for the embodiment illustrated in FIG. 2 has a diameter of about 0.387 inches, with the outside diameter of the shaft 30 at that point being about 0.5 inches. The intermediate portion 32 of the passageway has a generally conical configuration, in essence having the configuration of a right circular cone. The passageway portion 32 is dimensioned so that it comprises a means for allowing free fiber movement therewithin, so that the fibers can be lifted up a substantial distance to wrap around the core during the production of the yarn Y from sliver S. For the particular structure illustrated in FIG. 2, the passageway sections 31, 32 may be formed as follows:

Using a number 4 center drill, the end 21 is concentrically penetrated to a depth of about 0.51 inches.

Using a 15/64 inch drill, the end 21 is concentrically re-penetrated to the depth of about 0.497 inches.

Using ¼ inch end mill, the end 21 is again concentrically penetrated to a depth of about 0.42 inches.

Using a ⅜ inch 60° countersink, the end 21 is again concentrically penetrated to a depth of 0.52 inches.

Passageway section 33 is formed merely by concentrically penetrating the end 22 with a 1/16 inch drill, and drilling all the way to the preformed passageway portion 32. Typical other dimensions of the shaft 30 are as follows: the distance 42 equals about ⅜ inch; the diameter of the end 22 is about 0.503 inches; the thickness of the flange 37 is about 0.125 inches; the diameter of the portion receiving the bearing 36 is about 0.501 inches; and the length of the shaft 30 from the beginning of the first end 21 thereof until the beginning of the flange 37 is about 1.5625 inches.

Note that there is a tapered wall portion between the passageway section 32 at the perforations 40 and the passageway section 33, this tapered wall portion being illustrated by reference numeral 44 in FIG. 2. The provision of this tapered wall, compared to the same configuration of the shaft 30 without the tapered wall, leads to significantly better results.

For the embodiment illustrated in FIG. 2 the perforations 40 are preferably four in number, and are evenly spaced around the periphery of the shaft 30. Each perforation 40 is generally wedge-shaped. The width of each of the perforations 40 at the exterior surface of the shaft 30, which width is indicated generally by reference numeral 46, is about 0.34 inches. Each of the perforations 40 is formed by drilling an opening from the circumference to the passageway section 32 with a 3/32 inch drill at about a 34° angle, and then reaming to the vertical to form the surface 48 which is essentially perpendicular to an extension of the passageway third portion 33. The results achieved by providing the face 48 generally perpendicular to the passageway section 33 are significantly improved compared to the situation where the 3/32 inch hole is drilled at a 34° angle and there is no reaming.

Other illustrative configurations of nozzles which may be utilized according to the present invention are illustrated in FIGS. 3 through 7. While all of these nozzles are useful in forming yarn, it will be seen from the comparative test results for these nozzles that some produce yarn having significantly better properties than others.

Figure 3:
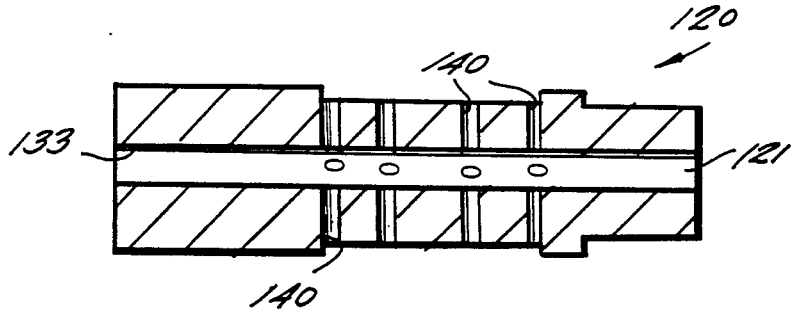
FIGS. 3 through 7 are side schematic cross-sectional views of exemplary other forms of "nozzles" that have been tested in vacuum spinning procedures.

The nozzle 120 illustrated in FIG. 3 has a generally constant ⅛ inch diameter through-extending passageway 133, with four rows of 1/16 inch diameter perforations 140 each at a 90° angle to the passageway 133.

Figure 4:
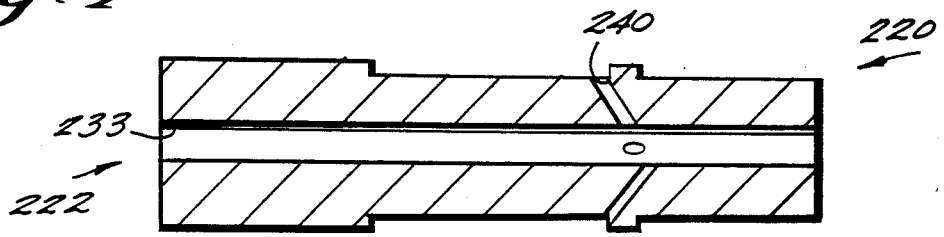

The nozzle 220 in FIG. 4 has a constant ⅛ inch diameter through-extending passageway 233 with four perforations 140 each 1/16 inch in diameter and angled in the direction of the second end 222.

Figure 5:
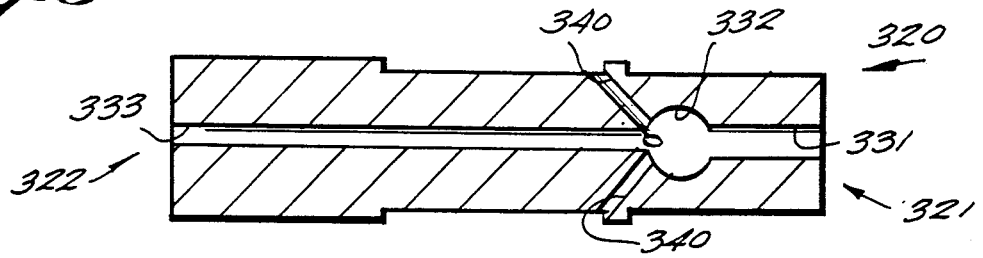

The nozzle 320 illustrated in FIG. 5 has a passageway portion 333 communicating with the second end 322 thereof that is 1/16 inch in diameter. Adjacent the first end 321 thereof the passageway portion 331 is about ⅛ inch in diameter. Between the passageway portions 331, 333 is a ¼ inch diameter spherical vacuum reservoir (or chamber) 332, with four 1/16 inch diameter angled perforations 340 extending outwardly from the reservoir 332. This embodiment is essentially the specific embodiment illustrated in FIG. 2 of the parent application.

Figure 6:
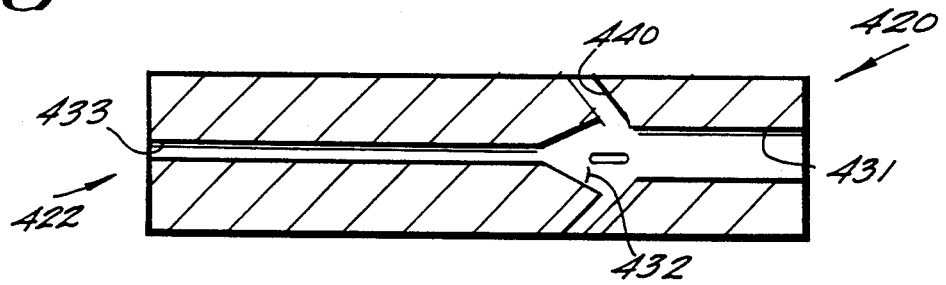

The nozzle 420 of FIG. 6 has a passageway portion 433 that is 1/16 inch in diameter, and a passageway portion 431 which is ⅛ inch in diameter. The passageway portion 432 may be considered a vacuum reservoir (or chamber), and has a conical shape. Four 1/16 inch angled perforations 440 are provided in communication with the reservoir 432.

Figure 7:
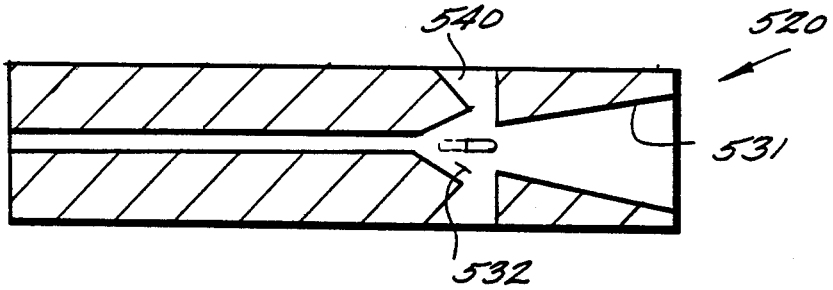

The FIG. 7 nozzle 520 is essentially identical to the nozzle 20 illustrated in FIG. 2 (note that the showing in FIG. 7 is schematic), except that the entire passageway section 531 has the shape of a cone frustum, and the shape of the passageway section 532—and the exact points that the perforations 540 come off of it—are slightly different.

The nozzles illustrated in FIGS. 3 through 6 are suitable for use in forming yarn from roving, but do not form particularly strong or useful yarns from a sliver. However the nozzles 520 of FIG. 7, and 20 of FIG. 2, are capable of forming strong yarns from sliver, having an increased total air flow from the first end thereof through the perforations to the vacuum source 18. Also the middle sections of the passageways (32, 532) allow free fiber movement so that the fibers will be lifted up and wrap around the core more securely. However the passageways 32, 532, are not so big that the fibers will be pulled through the perforations 40, 540 by the vacuum from source 18. Also in these embodiments the perforations collectively have effective cross-sectional areas relative to the effective cross-sectional area of the passageway section between the first end of the shaft and the perforations so that the dimensions of the perforations and passageway section are not a limiting factor in attaining optimal wrapping action of the fibers. In this way optimal wrap for any given application may be achieved.

The following table I gives the results of tests that have been done on the nozzles of FIGS. 3 through 7 utilizing the same composition of feed materials. In each case 1/19's poly/wool feed fibers were utilized, 55% 3d×3½"×4½" T-655 Dacron Natural (polyester), and 45% WP644 Wool Natural. The vacuum source 18 in each case applied a vacuum of about 14–15 inches of mercury, but the volume of air flow was significantly greater for the FIG. 7 embodiment than for the other embodiments.

TABLE I

| NOZZLE | TYPE OF STOCK | BREAKING STRENGTH (grams/denier) | ELONGATION |
|---|---|---|---|
| FIG. 3 | Roving | 308 | 13.66% |
| FIG. 4 | Roving | 349 | 15.65% |
| FIG. 5 | Roving | 390 | 17.72% |
| FIG. 6 | Roving | 424 | 14.8% |
| FIG. 7 | Sliver | 518 | 9.0% |

Surprisingly, the breaking strength of the yarn produced by the nozzle of FIG. 7 directly from sliver was greater than the breaking strength of the yarn produced from roving utilizing the nozzle of FIG. 6 (which is similar in construction to that of FIG. 7). Note that the nozzles of FIGS. 3 through 5 are suitable for use with a diffuser as described in the parent application, while those of FIGS. 6 and 7 are not designed for use with a diffuser.

Note also that the generally conically shaped passageway section (vacuum reservoir) 432 of the FIG. 6 nozzle achieves a yarn of higher break strength than for the spherical vacuum reservoir 332 embodiment of FIG. 5. Vacuum reservoirs 332, 432 also have other functions, such as providing a chamber (volume) for radial deflection of the fibers so that the wrapping function is facilitated.

The apparatus according to the present invention thus includes an elongated hollow shaft 30 having first end 21 and a second end 22, with a through-extending passageway 31, 32, 33. At least a portion of the entire circumference is perforated, by perforations 40. Means for mounting the shaft for rotation comprise the bearings 35, 36 and the housing 16, and means for rotating the shaft about its axis comprise the gear 24 and associated powered components (not shown). The feed rolls 26, and other components, comprise means for passing textile fibers S through the passageway 31–33 of the shaft 30, linearly, generally along the axis of rotation thereof, the fibers being fed into the first end 21. The source 18 applies a vacuum to the exterior of the shaft 30 so that at least some of the fibers or free ends of fibers passing through the shaft will draw toward the shaft perforations 40, and will be caused to rotate with the shaft as the fibers move linearly generally along the axis of rotation, the passageway portion 32 allowing sufficient volume for the fibers to lift and wrap around the core. Withdrawing rollers, or like conventional components, are provided as means for withdrawing the formed yarn Y from the end 22. Utilizing the embodiment illustrated in FIGS. 2 and 7, it is possible to make yarn having properties approaching that of ring spun yarn directly from sliver.

While the invention has been discussed primarily with respect to worsted yarns, short staple yarns of cotton, polyester, and blends thereof may also be formed using the invention. Likewise carpet yarns may also be formed.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. Apparatus for forming yarn comprising: an elongated hollow shaft having a first end and a second end, a through-extending passageway from the first end to the second end, at least a portion of the entire circumference of the shaft being perforated by perforations; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations and will be caused to rotate with said shaft as said fibers move linearly generally along the axis of rotation; means for withdrawing formed yarn from the second end of said shaft, opposite said first end thereof; and means provided between the first end and second end of said shaft for allowing free fiber movement so that at least some of the fibers or free ends of fibers adjacent said perforations will rise up and wrap around a core of fibers as the fibers pass through the passageway, said means including means defining a chamber having a larger cross-sectional area than that of said passageway second end, said perforations communicating with said opening.

2. Apparatus as recited in claim 1 wherein said means for allowing free fiber movement comprises means defining a generally conically shaped portion of said passageway having larger cross-sectional area portions thereof closer to said first end, and smaller cross-sectional area portions thereof closer to said second end.

3. Apparatus as recited in claim 2 wherein said conical portion comprises a right circular cone having the center thereof in alignment with said first and second ends.

4. Apparatus as recited in claim 3 wherein said perforations comprise perforations that extend from said conical portion to the exterior of said shaft.

5. Apparatus as recited in claim 4 wherein each of said perforations is generally wedge-shaped.

6. Apparatus as recited in claim 5 wherein a wall defining each of said perforations closest to said first end extends generally perpendicularly to the axis of rotation of said shaft.

7. Apparatus as recited in claim 6 wherein said shaft includes a tapered wall portion extending between the portion of each perforation closest to said second end and intersecting said passageway, and said passageway.

8. Apparatus as recited in claim 7 wherein said passageway includes, adjacent said first end thereof, a portion having the shape of a cone frustum, and wherein said passageway from said conical portion to said second end has a substantially constant diameter circular configuration, and is of significantly less cross-sectional dimension than said conical portion and said cone frustum portion adjacent said first end.

9. Apparatus for forming yarn comprising: an elongated hollow shaft having a first end and a second end, a through-extending passageway from the first end to the second end, at least a portion of the entire circumference of the shaft being perforated by perforations; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations and will be caused to rotate with said shaft as said fibers move linearly generally along the axis of rotation; means for withdrawing formed yarn from the second end of said shaft, opposite said first end thereof; and wherein said passageway includes a first portion adjacent said first end of said shaft, said first portion having the shape of a cone frustum, and having a significantly greater cross-sectional area than a portion of said passageway adjacent said second end of said shaft.

10. Apparatus as recited in claim 9 wherein the total effective cross-sectional areas of all of said perforations is generally equal to the effective operative cross-sectional area of said first portion of said passageway, so that optimum fiber wrapping action can be attained.

11. Apparatus as recited in claim 10 wherein each of said perforations has a generally wedge-shape.

12. Apparatus as recited in claim 11 wherein a wall defining each of said perforations closest to said first end extends generally perpendicularly to the axis of rotation of said shaft.

13. Apparatus for forming yarn comprising: an elongated hollow shaft having a first end and a second end, a through-extending passageway from the first end to the second end, at least a portion of the entire circumference of the shaft being perforated by perforations; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations and will be caused to rotate with said shaft as said fibers move linearly generally along the axis of rotation; means for withdrawing formed yarn from the second end of said shaft, opposite said first end thereof; and wherein said perforations have effective cross-sectional areas relative to the effective cross-sectional area of said passageway between said first end and said perforations so that optimum fiber wrapping action is achieved.

14. Apparatus as recited in claim 13 wherein each of said perforations has a generally wedge-shape.

15. Apparatus as recited in claim 14 wherein a wall defining each of said perforations closest to said first end extends generally perpendicularly to the axis of rotation of said shaft.

16. Apparatus for forming yarn comprising: an elongated hollow shaft having a first end and a second end, a through-extending passageway from the first end to the second end, at least a portion of the entire circumference of the shaft being perforated by perforations; means for mounting said shaft for rotation about an axis; means for rotating said shaft about its axis; means for passing textile fibers through the through-extending passageway of said shaft linearly, generally along the axis of rotation thereof, the fibers being fed into the first end thereof; means for applying a vacuum to the exterior of said shaft so that at least some of the fibers or free ends of fibers passing through said shaft will draw toward the shaft perforations and will be caused to rotate with said shaft as said fibers move linearly generally along the axis of rotation; means for withdrawing formed yarn from the second end of said shaft, opposite said first end thereof; and means defining a combined vacuum reservoir and chamber for radial deflection of fibers in said shaft adjacent said first end thereof and from which said perforations extend, said combined vacuum reservoir and chamber having a generally conical shape.

17. A method of spinning yarn comprising the steps of:

drafting a sliver of fibers so as to produce a drafted sliver;

feeding the drafted sliver in a linear direction A, in a fiber mass;

passing the fiber mass into the interior of a hollow shaft rotatable about an axis generally coincident with the direction A, the shaft having perforations along the circumference of a portion thereof, and having an enlarged interior chamber at the perforations;

applying a vacuum to the circumferential exterior of the perforated portion of the shaft sufficient to attract some of the fiber mass inside the shaft toward the shaft interior surface; and rotating the shaft at high speed so that the ends of certain of the fibers interior of the shaft rotate with the shaft as they are moving in the direction A, and so that those ends extend into the enlarged interior chamber so as to ultimately wrap around other portions of the fiber mass, to produce a final yarn.

18. A method as recited in claim 17 wherein the method steps are practiced so that the final yarn produced has a break strength comparable to a break strength of at least 500 grams per denier for a yarn produced from 1/19's count fibers of 55 percent polyester and 45 percent wool.

19. A method of making yarn having properties near those of ring-spun-yarn, using a rotating hollow shaft having generally radially extending perforations open to a vacuum and an enlarged interior chamber, comprising the steps of: passing air and a bundle of fibers through the rotating hollow shaft having the generally radially extending perforations open to a vacuum; and allowing air to pass through the perforations to thereby radially deflect certain of the fiber ends of the bundle of fibers into the interior chamber, for wrapping about the remainder of the bundle of fibers.

20. Apparatus for forming yarn as recited in claim 1 wherein said means for rotating said shaft about its axis comprises means for effecting either clockwise or counterclockwise rotation so that the apparatus can make yarn having either a Z or S twist, as desired.

* * * * *